US005204486A

United States Patent [19]

Kim et al.

[11] Patent Number: 5,204,486

[45] Date of Patent: Apr. 20, 1993

[54] KEYBOARD DEVICE OF AN ELECTRONIC KEYBOARD INSTRUMENT

[75] Inventors: Myung H. Kim; Woo H. Kim, both of Seoul; Byung J. Choi, Kyungki-do, all of Rep. of Korea

[73] Assignee: Gold Star Co., Ltd., Seoul, Rep. of Korea

[21] Appl. No.: 689,972

[22] Filed: Apr. 23, 1991

[30] Foreign Application Priority Data

| | | | |
|---|---|---|---|
| Apr. 30, 1990 | [KR] | Rep. of Korea | 6287/1990 |
| Jun. 30, 1990 | [KR] | Rep. of Korea | 9865/1990 |
| Aug. 31, 1990 | [KR] | Rep. of Korea | 13658/1990 |
| Dec. 29, 1990 | [KR] | Rep. of Korea | 22437/1990 |

[51] Int. Cl.[5] ..... G10C 3/12

[52] U.S. Cl. ..... 84/439; 84/433; 84/434; 84/440

[58] Field of Search ..... 84/439, 29, 433, 434, 84/435, 436, 437, 440, DIG. 7

[56] References Cited

U.S. PATENT DOCUMENTS

| | | | |
|---|---|---|---|
| 3,903,780 | 9/1975 | Aliprandi | 84/433 |
| 4,217,803 | 8/1980 | Dodds | 84/439 |
| 4,667,563 | 5/1987 | Wakuda et al. | 84/439 |
| 4,723,471 | 2/1988 | Sugimoto | 84/439 |
| 4,890,533 | 1/1990 | Katsuta et al. | 84/439 |

*Primary Examiner*—William M. Shoop, Jr.
*Assistant Examiner*—Helen Kim
*Attorney, Agent, or Firm*—Fish & Richardson

[57] ABSTRACT

Disclosed is a keyboard device of an electronic keyboard instrument generating a sound upon actuation of a switch disposed on a main plate by a pushing operation of a keyboard; the device includes a touch element varying in position according to the operation of the keyboard and a guide element for guiding the touch element, so that pushing force of the keyboard may be regulated. Therefore, this device enables a player to feel the same sense of touch as that in a common piano by eliminating a sense of friction which may be exerted upon his finger when pushing down the keyboard.

13 Claims, 7 Drawing Sheets

KEYBOARD DEVICE OF AN ELECTRONIC KEYBOARD INSTRUMENT

BACKGROUND OF THE INVENTION

1. Field of the Invention

The present invention relates to a keyboard device of an electronic musical instrument and more particularly to a keyboard device of an electronic keyboard instrument which enables a player to feel substantially the same sense of touch as that in a common piano by eliminating a sense of friction which may be exerted upon his finger when pushing down a key.

2. Description of the Prior Art

A keyboard device of a prior art electronic keyboard instrument, as shown in FIG. 1 of the accompanying drawings, comprises an actuator (2) projecting downwardly from a lower surface of a keyboard(1) and movable up and down therewith, and a switch(3) fixedly secured to a main plate(4) at a position below the actuator(2) to be actuated by the descending actuator. The keyboard(1) also has at its forward end a downwardly protruding stopper(5) which engages with a groove formed in the main plate(4) to limit the upward movement of the keyboard (1). Further, a keyboard guide(6) is disposed on the underside of the keyboard(1), and a keyboard guider(7) is fixedly secured to the main plate(4) to guide the keyboard guide(6) during the upward and downward movements of the keyboard(1). A rear end of the keyboard(1) having an insertion groove(9) is inserted into a hinge hole(4*a*) of the main plate(4) to form a pivoting point about which the keyboard pivots. In addition, a coil spring(8) is mounted between the lower surface of the keyboard(1) and the main plate(4) to bias upwardly the keyboard. With this construction, when the keyboard(1) is not actuated, it is maintained in a horizontal position by the coil spring(8) urging the keyboard upwardly and the stopper(5) limiting the upward movement of the keyboard.

In the prior keyboard device as described above, therefore, when a player presses down the keyboard(1) for playing the musical instrument, the keyboard is pivoted downwardly about the pivoting point of its rear end while compressing the coil spring(8). As a result, the downwardly protruding actuator(2) descending together with the keyboard contacts the switch(3) to switch on it, thereby generating a sound of the electronic musical instrument. In this state, upon withdrawal of his finger from the keyboard, the keyboard returns to its original position by the resilient restoring force of the compressed coil spring(8) and the switch(3) is switched off, whereby the generation of sound stops.

This prior keyboard device however has a drawback in that because the keyboard is simply supported resiliently only by the coil spring, the more the player presses down the keyboard, the more heavy his finger feels. This can be seen in the graph of FIG. 2 illustrating Force-Stroke characteristic curves (F-S diagram) of the common piano indicated by a dotted line and the prior electronic piano indicated by a solid line. The keyboard device of the prior electronic musical instrument makes the player need use force which abruptly increases in proportion to an increase in key stroke, as compared with the common piano, so that the more the player pushes down the keyboard, the more heavy his finger feels. Particularly, in the electronic keyboard instrument, since the player must continue to push down the keys for one cord by the fingers of his left hand until the cord is changed, he feels considerably heavier pushing force than that in the common piano.

SUMMARY OF THE INVENTION

The present invention has been devised in view of the above-mentioned prior art device, and particularly to eliminate the disadvantages thereof, and has an object to provide a keyboard device of an electronic keyboard which comprises means between the keyboard and a main plate for regulating pushing force of a keyboard to give substantially the same sense of touch as that in a common piano, thereby enabling a player to play natural expression.

To achieve the object, there is provided according to a first aspect of the present invention a keyboard device of an electronic keyboard instrument generating a sound upon actuation of a switch disposed on a main plate by a pushing operation of a keyboard, comprising touch means varying in position according to the operation of the keyboard, and guide means for guiding the touch means in contact with the means, whereby pushing force of the keyboard may be regulated.

According to a second form of the present invention, there is provided a keyboard device of an electronic keyboard instrument according to the first aspect, wherein said touch means comprises a guide bar protruding downwardly from an underside of the keyboard, and said guide means comprises a guide member having a stepped friction surface formed on one side.

According to a third aspect of the present invention, there is provided a keyboard device of an electronic keyboard instrument according to the first aspect wherein said touch means comprises a guide protrusion of a triangular cross-section shape projecting downwardly from the underside of the keyboard, and said guide means comprises a pair of spaced rollers urged into contact with the guide protrusion by a spring and movable toward and away from each other along slots formed in opposite guide plates.

According to a fourth aspect of the present invention, there is provided a keyboard device of an electronic keyboard instrument according to the first aspect, wherein said touch means comprises a bent-type leaf spring having a bent free end portion and fixed at the opposite side to the main plate with its central bent portion held in contact with the lower surface of the keyboard, and said guide means comprises a stepped guide plate, with which the bent end portion of the leaf spring is in contact.

According to a fifth aspect of the present invention, there is provided a keyboard device of an electronic keyboard instrument according to the first aspect, wherein said touch means comprises a guide bar protruding downwardly from the underside of the keyboard, and said guide means comprises a guide plate fixed to the main plate, and a slide member of a generally triangular crosssection shape biased by a spring connected at one end to one side of the member and slidable on the guide plate against the biasing force of the spring.

BRIEF DESCRIPTION OF THE DRAWINGS

The invention will be more fully understood from the following detailed description thereof, taken in connection with the accompanying drawings in which.

DESCRIPTION OF THE PREFERRED EMBODIMENT

Figure 1:
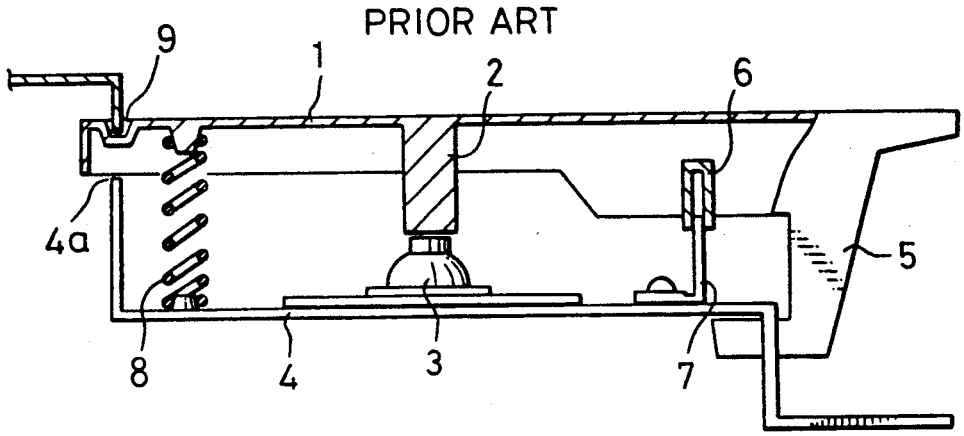
F I G. 1 PRIOR ART
FIG. 1 is a side view, partly in cross section, of a prior art keyboard device.
Figure 2:
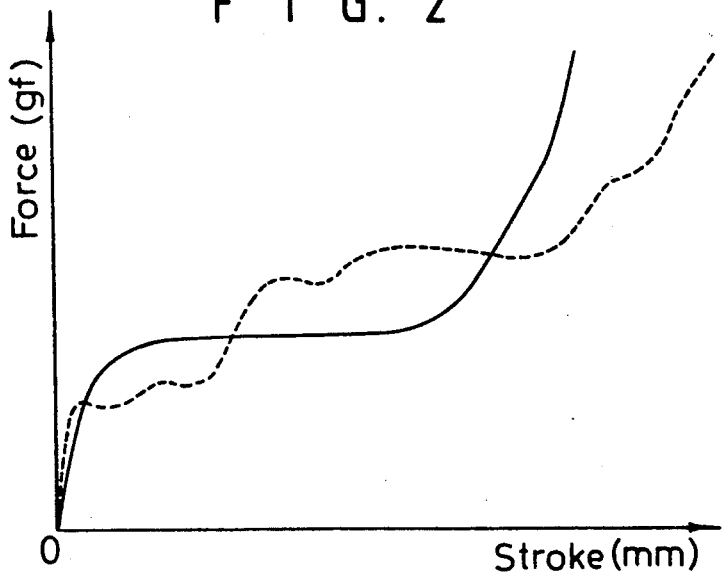
FIG. 2 is a graph illustrating Force-Stroke characteristics of the prior electronic piano and a common piano.

The present invention is identical in basic function with the prior keyboard device in that it generates a sound upon actuation of a switch disposed on a main plate according to an operation of a keyboard by a player, but is advantageous over the prior device in that an improved sense of touch of the keyboard, similar to that of the common piano as shown in FIG. 2, is obtained by replacing a simple coil spring between the keyboard and the main plate with novel touch and guide means kept in frictional contact with each other, and changing the load in proportion to the stroke by the touch and guide means. The touch and guide means may be embodied in several forms and particular embodiments of the invention will now be described in detail with reference to FIGS. 3 through 13 of the accompanying drawings.

Embodiment 1

Figure 3:
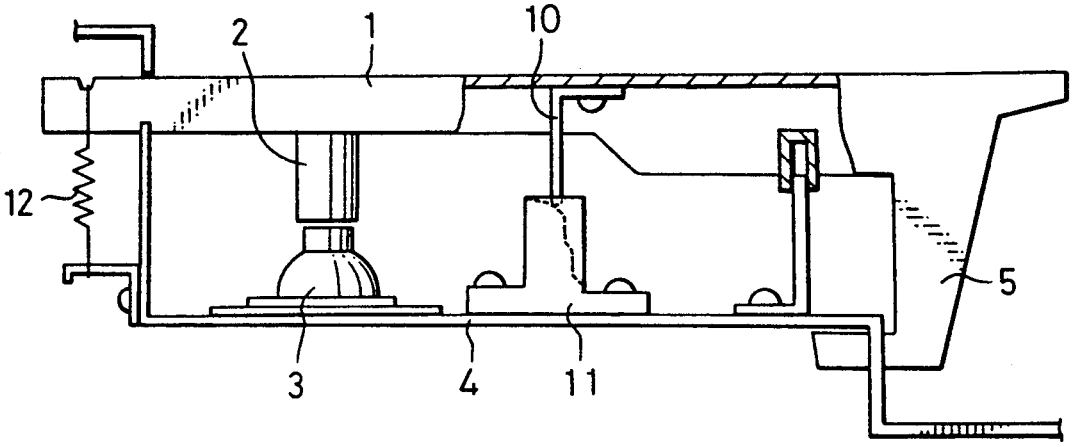
FIG. 3 is a side view, partly in cross section, of an embodiment of a keyboard device according to the present invention.
Figure 4:
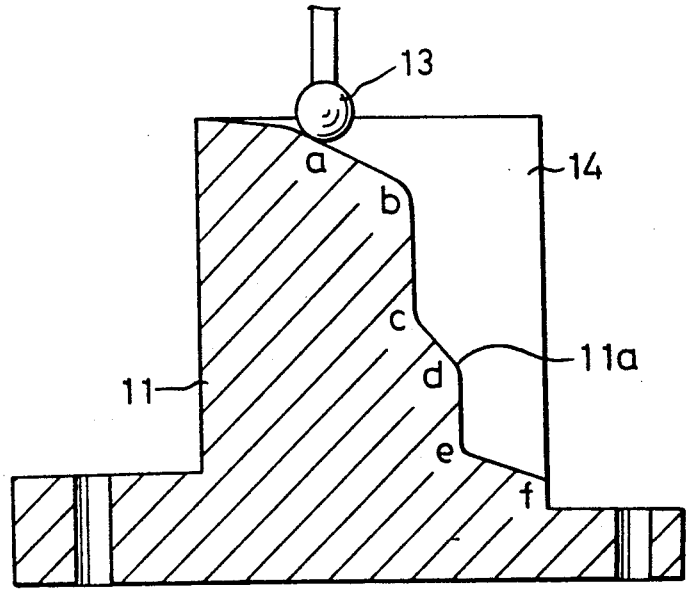
FIG. 4 is a side view of a guide member of the device shown in FIG. 3.
Figure 5:
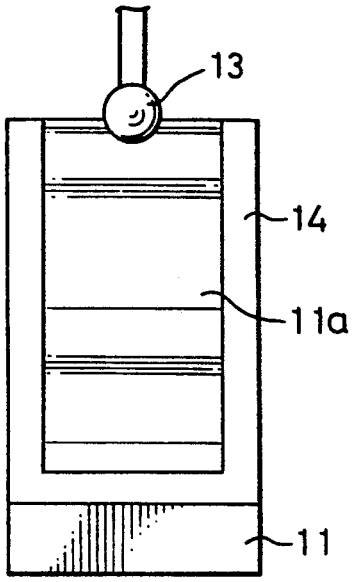
FIG. 5 is a front elevational view of the guide member of FIG. 4 incorporating guide plates.

Referring first to FIGS. 3 through 5, there is shown a first embodiment of a keyboard device of an electronic keyboard instrument according to the present invention, comprising a keyboard(1) having an actuator(2) protruding downwardly from its underside, and a switch(3) disposed on a main plate(4) to be switched on by the actuator(2), thereby generating a sound, like a prior keyboard device. In this embodiment of the invention, however, a coil spring of the prior art device arranged between the keyboard(1) and the main plate(4) to bias upwardly the keyboard is replaced with a guide bar(10) protruding downwardly from the underside of the keyboard and serving as touch means varying in position according to an operation, i.e., upward and downward movements of the keyboard, and a guide member(11) with a stepped friction surface(11*a*) on one side disposed on the main plate(4) and serving as guide means for guiding the touch means by contacting the guide means with the touch means.

In addition, the keyboard(1) is provided at its forward end with a downwardly protruding stopper(5) which serves to limit the upward movement of the keyboard by engaging with a groove formed in the main plate (4), like the prior art. In this embodiment, a spring(12) is arranged between the rear end of the keyboard(1) and the main plate(4) to maintain the keyboard in its normal horizontal position under tension of the spring.

The guide bar(10) protruding downwardly from the lower surface of the keyboard(1) is made of elastic plastic materials or wood and has an integrally formed spherical tip of low frictional force. As shown in FIG. 4, the guide bar may comprise a leaf spring provided at its free end with a separately formed spherical tip(13) to further enhance the frictional force and resiliency thereof. The friction surface(11*a*) of the guide member(11), on which the spherical tip(13) of the guide bar slides, comprises stepped displacement sections(a-b-c-d-e-f) as shown in FIG. 4, wherein the a-b, c-d and e-f sections of the displacement sections are inclined to increase the frictional force of the guide bar(13), while the b-c and d-e sections are vertical to decrease the frictional force. As shown in FIG. 5, the guide member(11) also has guide plates(14) attached to opposite sides of the stepped friction surface(11*a*) to prevent the spherical tip(13) sliding along the friction surface from escaping laterally from the surface In the operation of the device of this embodiment, when the player pushes down the keyboard(1) held in its normal horizontal position as shown in FIG. 3, the keyboard is pivoted downwardly while extending the spring(12) arranged at its rear end portion, and thus the spherical tip(13) of the guide bar(10) disposed on the underside of the keyboard slides downwardly on the friction surface(11*a*) of the guide member(11) along the displacement sections (a-b-c-d-e-f) of the surface. With this downward movement of the keyboard, the actuator(2) fixed to the lower surface of the keyboard actuates the switch(3) on the main plate (4) to switch it on. When the spherical tip(13) moves along the stepped displacement sections of the friction surface(11*a*) of the guide member(11) while being kept in contact with the sections, the leaf spring portion of the guide bar(10) to which the spherical tip is connected, is resiliently bent by its own resiliency, and thus the frictional force of the spherical tip(13) sliding on the stepped friction surface (11*a*) and the reiliency on the leaf spring cause a change of force relative to a stroke of the keyboard(1), so that the characteristic curve of the electronic keyboard instrument may be altered to be analogous to that of the common piano.

Although in this embodiment the guide bar is arranged to the keyboard and the guide member is disposed on the main plate, the arrangement of the elements may be reversed having the same effect so that the guide bar is disposed on the main plate and the guide member is secured of the keyboard.

Embodiment 2

This embodiment of the invention is identical with the above first embodiment and the prior art device in that the actuator of the keyboard switches on and off the switch on the main plate according to a positional change of the keyboard. The feature of this embodiment is the modified construction of the touch means and guide means as shown in FIGS. 6 through 8.

Figure 6:
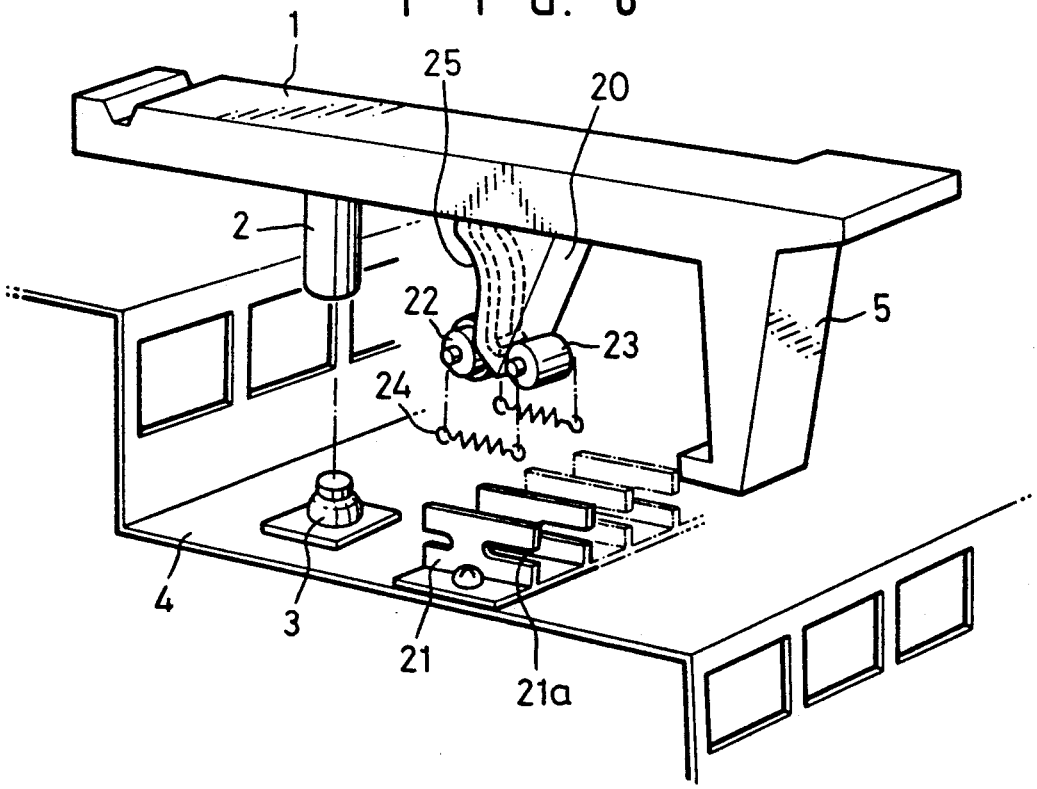
FIG. 6 is an exploded perspective view of a second embodiment of the keyboard device according to the present invention.
Figure 7A:
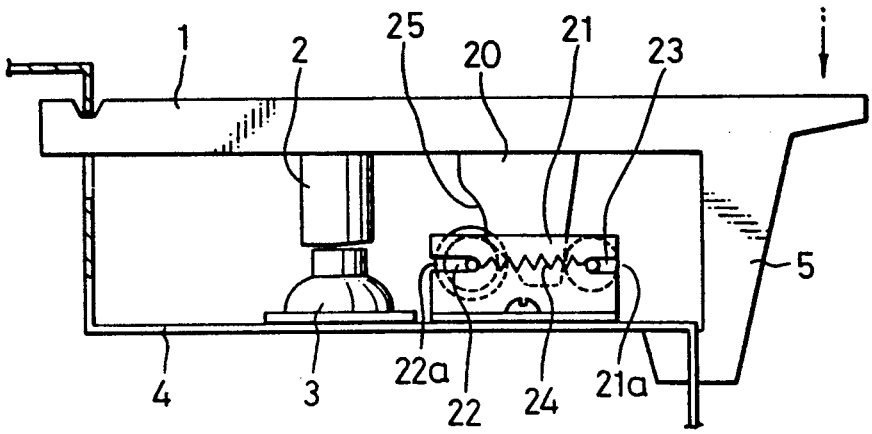
FIGS. 7(*a*) and (*b*) are side views for explaining the operation of the keyboard device shown in FIG. 6.
Figure 7B:
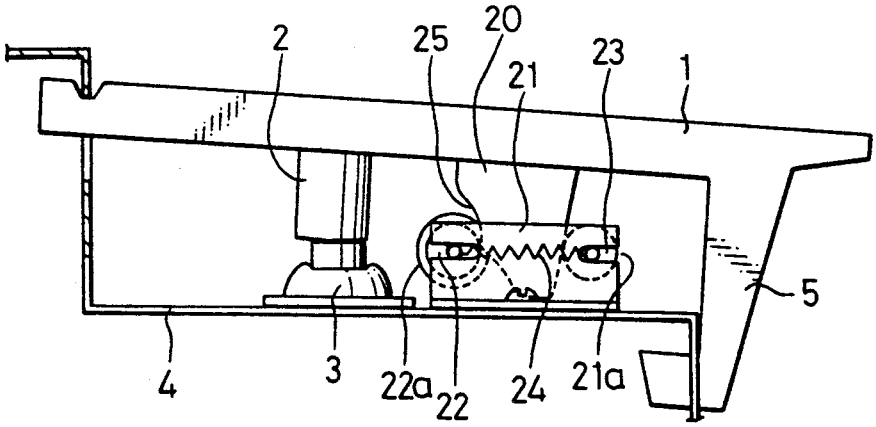

As shown in FIG. 6, in this embodiment the touch means comprises a guide protrusion(20) of a triangular cross-section shape protruding downwardly from the lower surface of the keyboard(1), and the guide means comprises a pair of spaced confronting rollers(22,23) supported for horizontally reciprocating movements in slots(21*a*) formed in opposite end portions of each of parallel guide plates(21), and urged into contact with the guide protrusion(20) under the tension of a spring (24) arranded between the rollers. The guide plates(21) are fixedly secured to the upper surface of the main plate(4). The guide protrusion(20) has a curved surface(25) formed on one side and moves up and down between the pair of the rollers(22,23) with the movements of the keyboard while being kept continuously in contact with the rollers. With the movement of the guide protrusion, the curved surface(25) causes a change of the pushing force of the keyboard.

Figure 8:
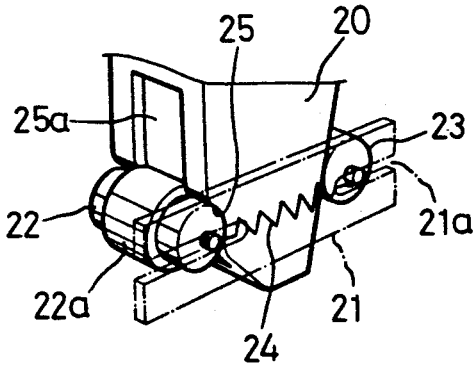
FIG. 8 is a perspective view of a guide bar and rollers of the device of FIG. 6 in contacting relation with each other.

In addition, as shown in FIG. 8, one of the rollers(22) has a stepped portion or an enlarged diameter portion(-22*a*), which is slidably received in a guide groove(25*a*) formed in the curved surface(25) of the guide protrusion(20). The stepped portion(22*a*) of the roller(22) guides the upwardly and downwardly moving guide protrusion(20), thereby preventing guide protrusion from running off the track thereof.

Operation of the device of this embodiment will now be described with reference to FIG. 7. When the player pushes down the keyboard (1) held in its normal horizontal position as shown in FIG. 7(*a*), the keyboard is pivoted downwardly about a pivoting point provided at its rear end portion, and thus the guide protrusion(20) positioned between the confronting rollers(22,23) descends while moving the rollers(22,23) in opposite directions, i.e., away from each other, as shown in FIG. 7(*b*). The rollers(22,23) moving in opposite directions according to the upward and downward movements of the guide protrusion(20) are guided by the slots(21*a*) formed in the opposite guide plates(21) which are secured to the main plate(4). Since the curved surface(25) of the guide protrusion is held in contact with the roller(22) movable forwardly and backwardly, the pushing operation of the keyboard may be smoothly effected. Further, since the stepped portion(22*a*) of the roller(22) is received and guided in the guide groove(25*a*) of the curved surface(25) , the keyboard(1) may be smoothly moved without rocking laterally. Then, if the external force exerted on the keyboard (1) is removed, the rollers(22,23) return to their original positions by the resilient restoring force of the spring(24) arranged between the rollers, thereby pushing up the lowered guided protrusion(20) between the rollers.

Force relative to a stroke of teh keyboard may be regulated by the upwardly and downwardly movable guide protrusion and the forwardly and backwardly movable rollers, so that the substantially same touch sense of the keyboard as that in the common piano may be obtained.

Embodiment 3

Figure 9:
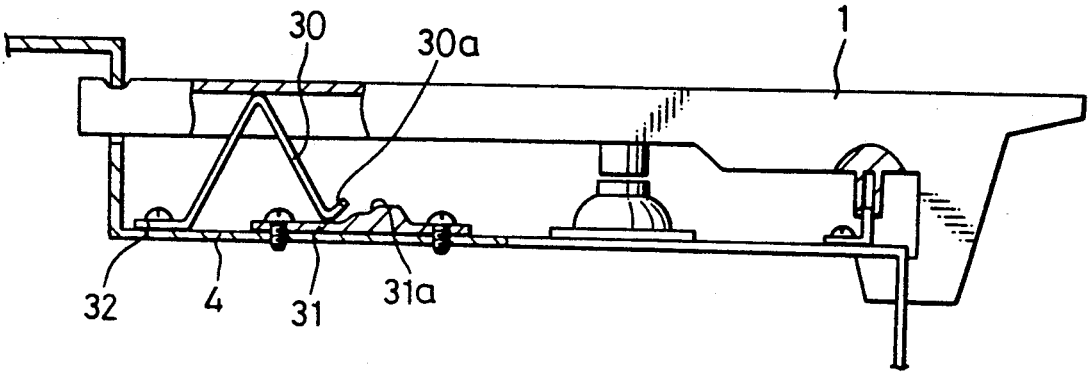
FIG. 9 is a side view, partly in cross section, of a third embodiment of the keyboard device according to the present invention.
Figure 10:
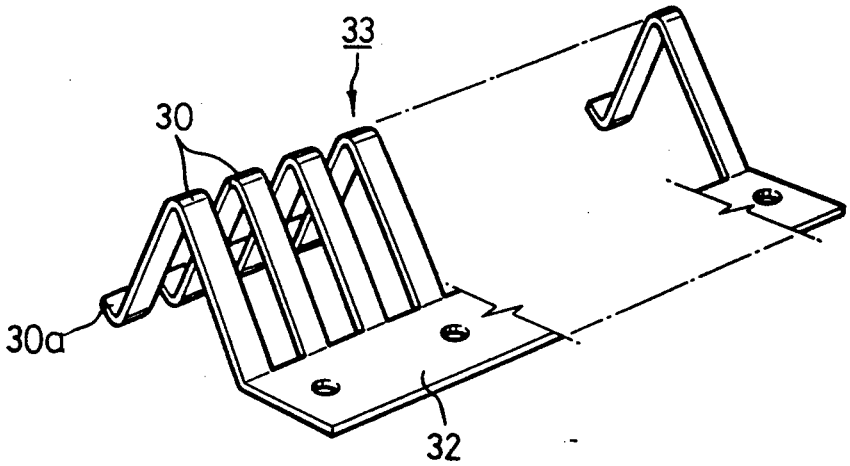
FIG. 10 is a perspective view, with portions broken away, of a leaf spring of the device shown in FIG. 9.
Figure 11:
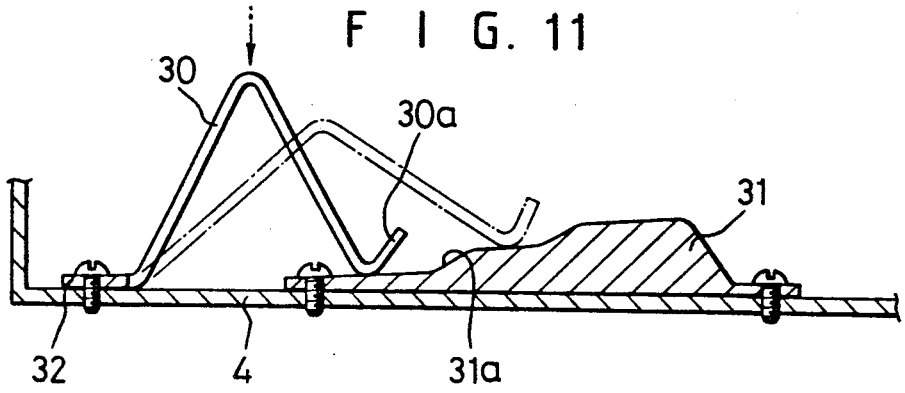
FIG. 11 is a sectional view for explaining the operation of the keyboard device of FIG. 9.

This embodiment of the invention as shown in FIGS. 9 through 11 is different from the above first and second embodiments in that while in Embodiments 1 and 2the touch means varies in position according to the operation of the keyboard directly to the keyboard, the touch means of this embodiment are disposed on the main plate in contact with the keyboard and the guide means secured to the main plate.

As shown in FIG. 9, the touch means comprises a bent leaf spring(30) of a generally inverted V-shape fixed at only one side to the main plate(4) with its central bent portion, i.e., an apex of the inverted V-shaped held in contact with the lower surface of the keyboard(1), and thus resiliently extendible according to the movements of the keyboard. The leaf spring(30) also has an upwardly bent portion(30*a*) formed at its free end, which is in contact with the upper surface of the guide means fixedly secured to the main plate(4). In this embodiment, the guide means comprises a guide(31) having a stepped contact surface (31*a*) formed on its upper side, with which the bent end portion(30*a*) of the leaf spring(30) is in contact. More particularly, as shown in FIG. 10, the leaf spring(30) comprises a plurality of bent leaf spring strips(33) integrally connected to one side of a fixing piece(32), which is used for fixing the spring(30) to the main plate(4). With this construction, the mounting of the spring may be simply accomplished.

Operation of the device of this embodiment will now be described with reference to FIG. 11. When the player pushes down the keyboard (1) which is held in its normal horizontal position by the leaf spring (30) as shown in FIG. 9, the keyboard is pivoted downwardly about a pivoting point provided at its rear end, and thus the leaf spring(30) is extended to a position as indicated by the dot-and-dash lines in FIG. 11. At this time, the frictional movement of the bent end portion(30*a*) of the leaf spring on the stepped contact surface(31*a*) of the guide plate(31) causes a change of force relative to a stroke of the keyboard. Such a change of force is the same as the effect obtained in the above described embodiments and also provides the same characteristics and sense of touch sense of the keyboard as those in the common piano. Then, if the external force applied to the keyboard is removed, the keyboard returns to its original position by the restoring force of the leaf spring(30).

Embodiment 4

Figure 12:
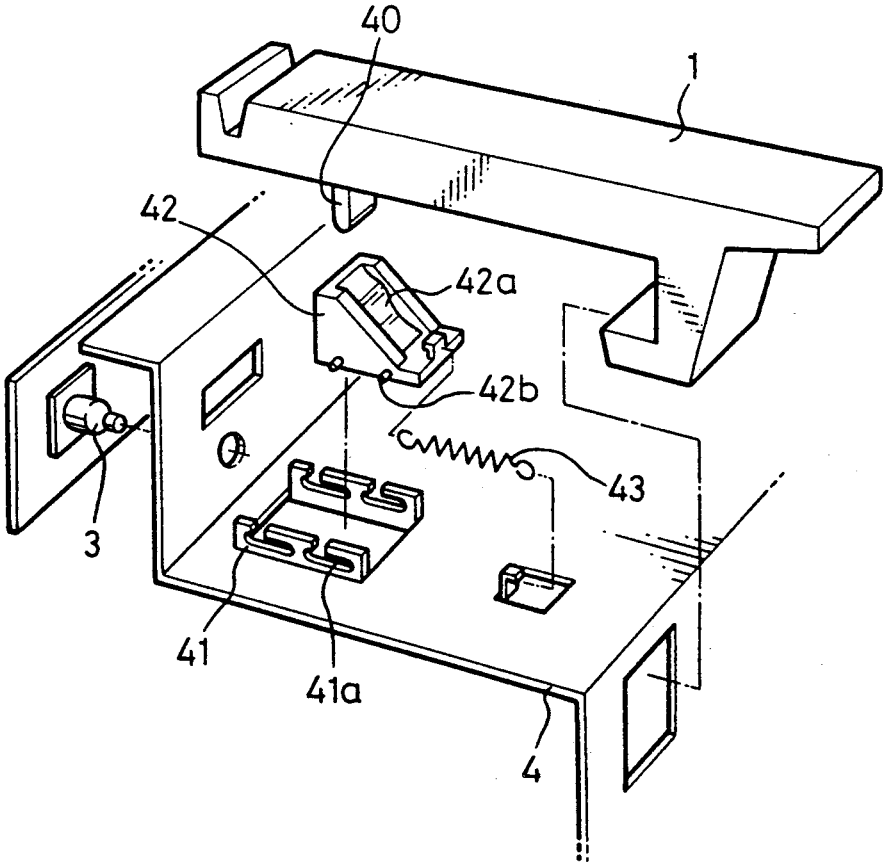
FIG. 12 is an exploded perspective view of a fourth embodiment of the keyboard device according to the present invention.
Figure 13A:
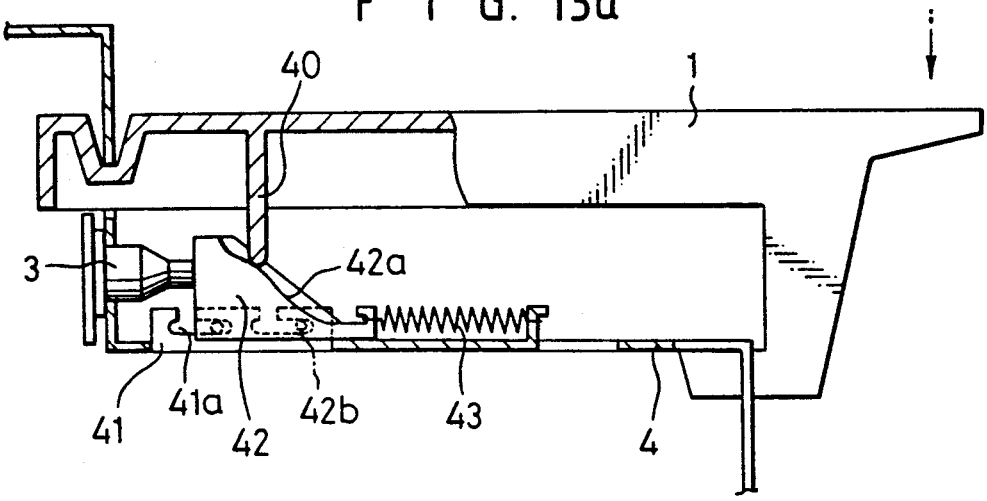
FIGS. 13 (*a*) and (*b*) are sectional views for explaining the operation of the keyboard device shown in FIG. 12.
Figure 13B:
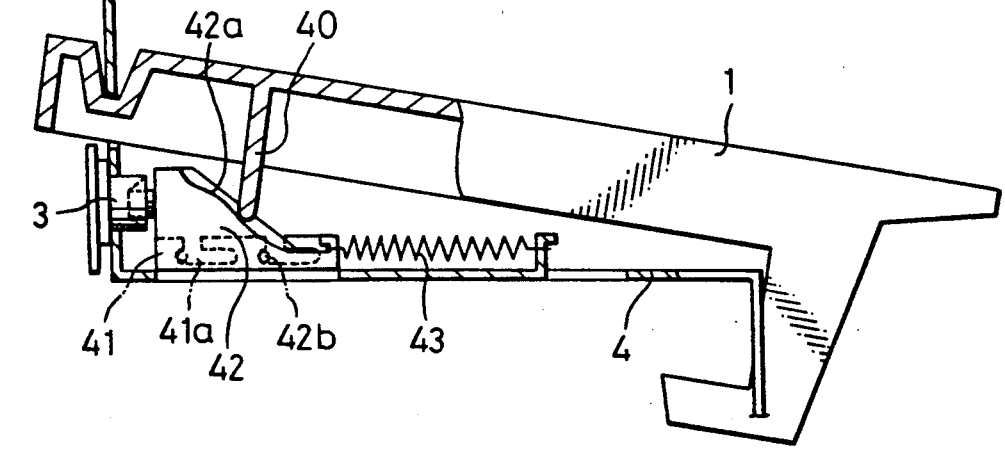

As shown in FIGS. 12 and 13, this embodiment comprises a downwardly protruding guide bar disposed on the keyboard as the touch means and a horizontally movable slide member as the guide means, ion order to effect a change of force exerted on the keyboard, such as in the embodiments described above, and thus obtain substantially the same sense of touch as that in a common piano. Particularly, is this embodiment, although the device may comprises the actuator fixed to the keyboard and movable therewith to actuate the switch disposed on the upper surface of the main plate, the actuator is replaced with the slide member movable in the horizontal direction according to the movement of the guide bar of the keyboard and arranged at the main plate to actuate a switch disposed on the back wall of the main plate, thereby effecting exact contact at all times, and thus improving operational reliability of the switch.

Referring to FIG. 12 showing an exploded perspective view of the device of this embodiment, the device comprises a guide bar(40) protruding downwardly from the lower surface of the keyboard(1), a guide plate(41) having guide grooves(41*a*) formed at opposite side walls, and fixedly secured to the main plate(4), and a slide member(42) of a generally triangular cross-section shape having projections(42*b*) slidably engaged with the guide grooves(41*a*) of the guide plate, and biased resiliently by a spring(43) which is connected at one end to one side of the slide member and at the other end to the main plate. In addition, the switch(3) is mounted perpendicularly to the back wall of the main plate(4) to be actuated by the slide member(42) sliding in the horizontal direction according to the downward movement of the keyboard. The sloping surface of the slide member(42) is formed with a guide recess(42*a*) having curved bottom surface, along which the guide bar(40) of the keyboard(1) may be moved.

Operation of the device of this embodiment will now be described with reference to FIG. 13. When the player pushes down the keyboard (1) which is held in its normal horizontal position by the guide bar (40) of the keyboard positioned at the upper end of the guide recess (42*a*) of the slide member(42) pulled in the right direction (as viewed in the drawing) under tension of the spring(43), as shown in FIG. 13(*a*), the keyboard is pivoted downwardly about a pivoting point provided at its rear end, and thus the guide bar(40) of the keyboard descends slidingly on the curved surface of the guide recess(42*a*) of the slide member(42), thereby pushing the slide member on the guide plate(41) in the left direction against the biasing force of the spring(43).

Since the slide member(42) moving in the left direction is guided in the guide plate (41) by the guide projections(42*b*) formed at the lower portions of the opposite sides of the slide member to be received in the guide grooves(41*a*) of the guide plate, the slide member may be smoothly moved without running off the track thereof. At the end of such a movement of the slide member(42), the slide member contacts the switch(3) confronting with its back side to switch on the switch, as shown is FIG. 13(*b*). In this state, if the player takes his finger off the keyboard(1), the slide member(42) returns to its original position by the restoring force of the extended spring(43), so that the switch(3) is switched off and the keyboard is pushed up and returned to its original position.

The curved sloping surface of the slide member(42), on which the guide bar(40) slides, causes a change of force relative to a stroke of the keyboard(1) during the downward movement of the keyboard. In this manner, the same sense of touch is achieved as that in the electronic keyboard instrument by the upwardly and downwardly sliding of the guide bar on the curved surface of the slide member.

Particularly, in this embodiment, the switch arranged at the vertical back wall, not the horizontal plane, of the main plate to be switched on and off by the slide member movable in the horizontal direction does not make poor contact with is liable to occur at the switch located below and actuated by the pivoting keyboard, such as in the above described embodiments, and thus and exact switching operation may always be accomplished.

While the preferred embodiments have been disclosed and described, it is to be understood that various changes and modifications may be made in the invention without departing from the spirit and scope thereof.

What is claimed is:

1. A keyboard device of an electronic keyboard instrument generating a sound upon actuation of a switch arranged at a main plate by a pushing operation of a keyboard, comprising a guide bar protruding from an underside of a key of the keyboard, and a guide member having a stepped friction surface which contacts the guide bar as it moves along the guide member in a stepwise path.

2. A keyboard device of an electronic keyboard instrument as claimed in claim 1, wherein said guide bar comprises a leaf spring having a spherical tip provided at its free end.

3. A keyboard device of an electronic keyboard instrument as claimed in claim 1, wherein the stepped friction surface of said guide member has displacement sections (a-b-c-d-e-f), and the a-b, c-d and e-f sections are inclined to increase frictional force of the guide bar, and the b-c and d-e sections are vertical to minimize frictional force.

4. A keyboard device of an electronic keyboard instrument as claimed in claim 1 or 3, wherein guide plates are disposed on opposite sides of the stepped friction surface of said guide member for guiding said guide bar.

5. A keyboard device of an electronic keyboard instrument, comprising a guide protrusion of a generally triangular cross-section shape protruding downwardly from the underside of the keyboard, and a pair of spaced rollers connected to be movable toward and away from each other and urged into contact with sides of the guide protrusion by a spring.

6. A keyboard device of an electronic keyboard instrument as claimed in claim 5, wherein said guide protrusion has a curved surface formed at one side contacting one of said rollers.

7. A keyboard device of an electronic keyboard instrument as claimed in claim 5, wherein said guide protrusion has a guide recess formed at a curved surface, and one of said pair of spaced rollers has a stepped portion which is received and guided in said guide recess.

8. A keyboard of an electronic keyboard instrument, comprising a bent-type leaf spring having a bent free end portion and an opposite side fixed to a main plate with its central bent portion held in contact with a lower surface of the keyboard, and a stepped guide plate, with which the bent end portion of said leaf spring is in contact.

9. A keyboard device of an electronic keyboard instrument as claimed in claim 8, wherein said leaf spring contacting the keyboard comprises a plurality of leaf spring strips integrally connected to one side of a fixing piece.

10. A keyboard device of an electronic keyboard instrument comprising, a guide bar protruding downwardly from the underside of the keyboard, a guide plate fixed to a main plate, and a slide member of a generally triangular cross-section shape biased by a spring connected at one end to one side of the slide member and slidable on said guide plate against a biasing force of said spring into contact with the guide bar.

11. A keyboard device of an electronic keyboard instrument as claimed in claim 10, wherein said guide plate has guide grooves formed at opposite side walls, and said slide member has guide projections which are slidably engaged with said guide grooves.

12. A keyboard device of an electronic keyboard instrument as claimed in claim 10, wherein a sloping surface of said slide member, on which said guide bar slides, is formed with a guide recess having a curved surface.

13. A keyboard device of an electronic keyboard instrument as claimed in claim 10, wherein a switch is mounted perpendicularly to a back wall of the main plate to be actuated by the slide member sliding in a horizontal direction.

* * * * *